US005282432A

United States Patent [19]

Fujita et al.

[11] Patent Number: 5,282,432

[45] Date of Patent: Feb. 1, 1994

[54] NEEDLE ATTACHMENT POSITION INDICATOR DEVICE

[75] Inventors: Shuji Fujita; Shiro Satoma; Yasushi Baba, all of Tokyo, Japan

[73] Assignee: Juki Corporation, Tokyo, Japan

[21] Appl. No.: 919,830

[22] Filed: Jul. 27, 1992

Related U.S. Application Data

[63] Continuation-in-part of Ser. No. 866,404, Apr. 10, 1992.

[30] Foreign Application Priority Data

Apr. 12, 1991 [JP] Japan ..... 3-079670

[51] Int. Cl.[5] ..... D05B 19/00; D05B 1/10; D05B 1/20; D05B 1/14

[52] U.S. Cl. ..... 112/121.11; 112/166; 112/168; 112/162

[58] Field of Search ..... 112/121.11, 445, 163, 112/168, 444, 165, 166, 167, 162

[56] References Cited

U.S. PATENT DOCUMENTS 4,265,188 5/1981 Suzuki et al. ..... 112/445
4,372,231 2/1983 Odermann et al. ..... 112/445
4,406,236 9/1983 Socha ..... 112/445
4,577,574 3/1986 Takahashi ..... 112/445

FOREIGN PATENT DOCUMENTS 0016724 10/1980 European Pat. Off. ..... 112/445

*Primary Examiner*—Clifford D. Crowder
*Assistant Examiner*—Paul C. Lewis
*Attorney, Agent, or Firm*—Tarolli, Sundheim & Covell

[57] ABSTRACT

There is provided a needle attachment position indicator device for use in a sewing machine of a type comprising a stitch pattern forming mechanism provided in a machine frame for permitting selection of one stitch pattern from a plurality of different stitch patterns, an actuator member disposed in the machine frame for permitting selection of the stitch pattern, an actuation mechanism disposed in the machine frame for setting the stitch pattern forming mechanism at selected stitch pattern in response to the selective actuation of the actuator member, and needle holding means having a plurality of needle attachment positions. The device includes an indicator member capable of indicating needle attachment position corresponding to the selected stitch pattern. in response to the selective actuation of the actuator member.

7 Claims, 11 Drawing Sheets

NEEDLE ATTACHMENT POSITION INDICATOR DEVICE

RELATED APPLICATION

This application is a Continuation-In-Part of application Ser. No. 866,404, Filed Apr. 10, 1992 and entitled Overlock Sewing Machine. The benefit of the earlier filing date of the aforementioned application Ser. No. 866,404 has been and hereby is claimed.

BACKGROUND OF THE INVENTION

1. Field of the Invention:

This invention relates to a needle attachment position indicator deice for use in sewing machines.

2. Prior Arts:

A sewing machine is known which permits selection of one of a plurality of sewing or stitch patterns, such as twin-needle/four-thread overlock stitching, double chain stitching, etc. due to its construction in which a looper may be connected to or disconnected from an oscillating shaft or motion of the machine may be changed, by means of a stitch shifting dial. Such a machine is so designed that the stitch patterns capable of being performed by the machine will be indicated on a front cover thereof by means of literal indications. Thus, rotation of the stitch shifting dial causes a lamp or lamps adjacent to the literal indications to be turned on, whereby one may determine which stitch pattern is selected.

It is sometimes necessary to change the needle position upon changing stitch pattern. Thus, conventional sewing machines include a needle clamp A having a plurality of needle attachment positions a1–a4, so that needles B may be selectively positioned (FIGS. 8 and 9). If the needles are erroneously positioned, the intended stitch pattern will not be formed. In particular, and when the needle clamp has four (4) needle attachment positions, it is difficult to determine which position needles are to be attached to. By this, attachment or detachment of needles requires a significant period of time, thus decreasing operation efficiency.

SUMMARY OF THE INVENTION

Accordingly, it is an object of the invention to provide a needle attachment indicator device which may visually indicate proper needle attachment position corresponding to a particular stitch pattern which is selected by a stitch shifting dial.

BRIEF DESCRIPTION OF THE DRAWINGS

For a better understanding of the invention, and to show how the same may be carried into effect, reference will now be made, by way of example, to the accompanying drawings in which like reference numerals refer to like elements.

DETAILED DESCRIPTION OF THE PREFERRED EMBODIMENTS

The invention will be explained in detail below with reference to the accompanying drawings.

Figure 1:
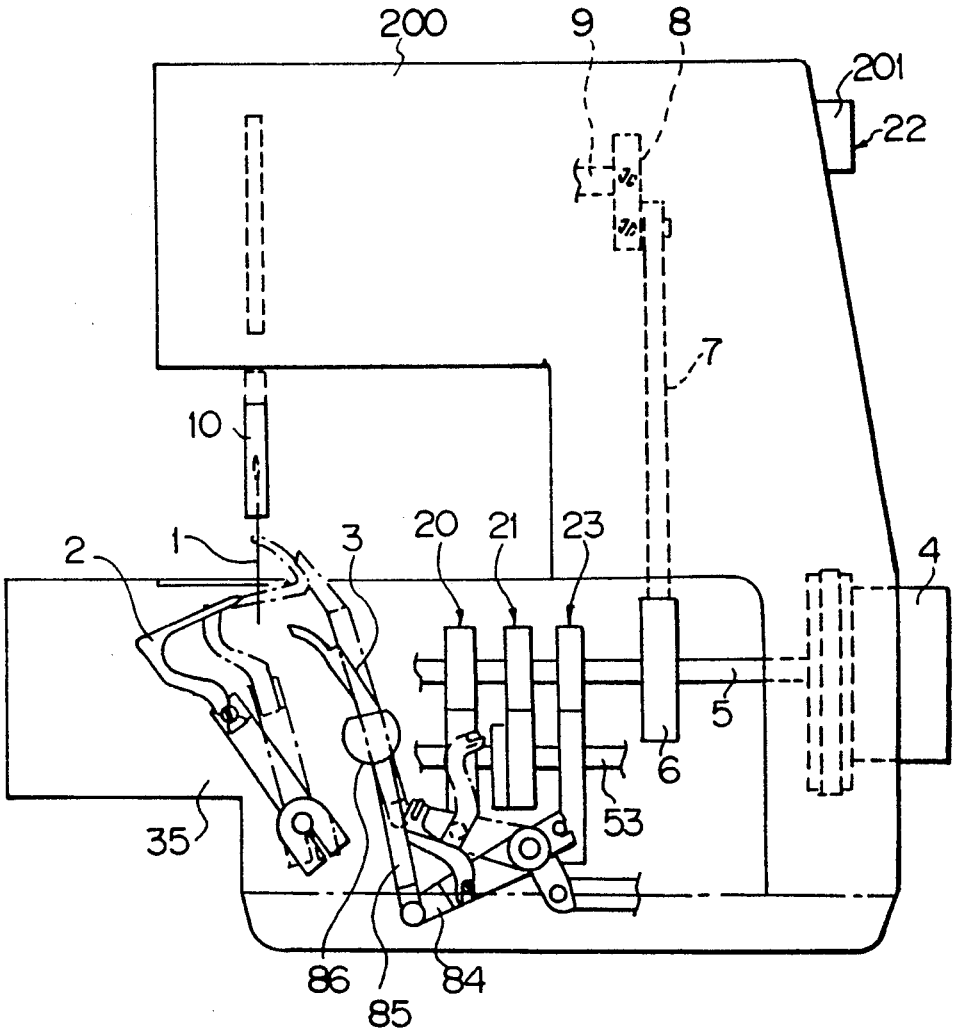
FIG. 1 is a front view of an overlock sewing machine.

With reference to FIG. 1 showing an overlock sewing machine according to the invention, the machine includes a needle 1 and lower and upper loopers 2 and 3. These loopers 2, 3 form a seam or stitches in cooperation with the needle 1. The needle 1, and upper and lower loopers 2, 3 are driven by a common driving means. The driving means includes, as known in the art, a fly wheel 4 and a main shaft 5 rotationally driven by the fly wheel 4. More particularly, the needle 1 is driven in the upward and downward directions at a desired timing or cycle when a needle bar 10 is driven by means of an eccentric cam 6, a connection rod 7 freely received by the eccentric cam, and a needle bar driving shaft 9 connected to the connection rod 7 through a connection part 8. This arrangement is well known in the art, and it is therefore believed that further explanation of such an arrangement will be unnecessary. The overlock sewing machine according to the invention includes a lower looper oscillating device 20 and lower looper back-and-forth oscillating device 21 for actuating the lower looper 2, and a motion change-over device 22 for alternatively switching the actuation between the lower looper oscillating device and lower looper back-and-forth oscillating device. The upper looper 3 is driven by an upper looper oscillating device 23.

The lower looper oscillating device 20 oscillates the lower looper 2 so as to perform an over-edging in cooperation with the upper looper 3 and the needle 1. The lower looper back-and-forth oscillating device 21 oscillates the lower looper 2 in the forward and backward directions so as to perform a double chain stitching in cooperation with the needle 1. At this time, the upper looper 3 remains immobile.

Figure 2:
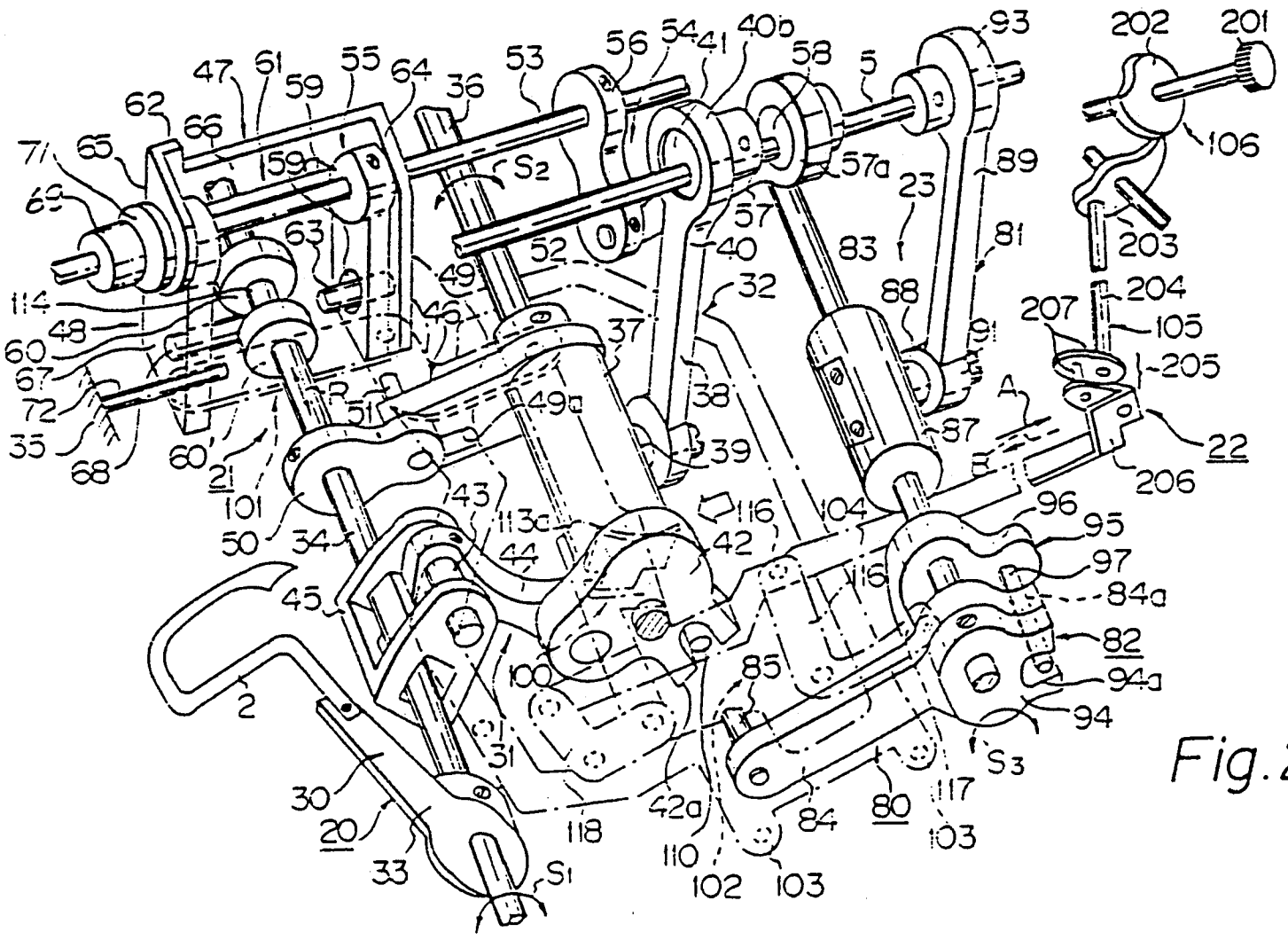
FIG. 2 is a perspective view of the overlock sewing machine shown in FIG. 1 illustrating a lower looper oscillating device, a lower looper back-and-forth oscillating device, an upper looper oscillating device and a motion change-over device.

With reference to FIG. 2, construction of and mutual relationship between the lower looper oscillating device 20, lower looper back-and-forth oscillating device 21, motion change-over device 22 and upper looper oscillating device 23 are shown.

The lower looper oscillating device 20 includes a lower looper support mechanism 30 for carrying the lower looper 2, and a lower looper driving mechanism 32 for oscillating the lower looper support mechanism 30 through a first oscillation connecting mechanism 31.

The lower looper support mechanism 30 includes a lower looper support arm 33 and a shaft 34 for the lower looper. The lower looper 2 is fixed to the lower looper support arm 33 at its proximal end, while the lower looper support arm is fixed to the lower looper shaft 34 at its opposite end. The shaft 34 for the lower looper is supported by a frame of the machine for rotation about the axis thereof and reciprocal movement in the longitudinal direction (see FIGS. 4 and 5). It should be noted that, in this specification, "back-and-forth movement" is meant reciprocal movement along the longitudinal direction of the lower looper shaft 34 (a direction in which a cloth, not shown, to be sewn is fed: feed direction), as shown by an arrow R in FIG. 2. On the other hand, "oscillational movement" of the looper 2 is meant reciprocal, rotational movement over an angular extension about the axis of the lower looper, as shown by an arrow S1 in FIG. 2.

Figure 4:
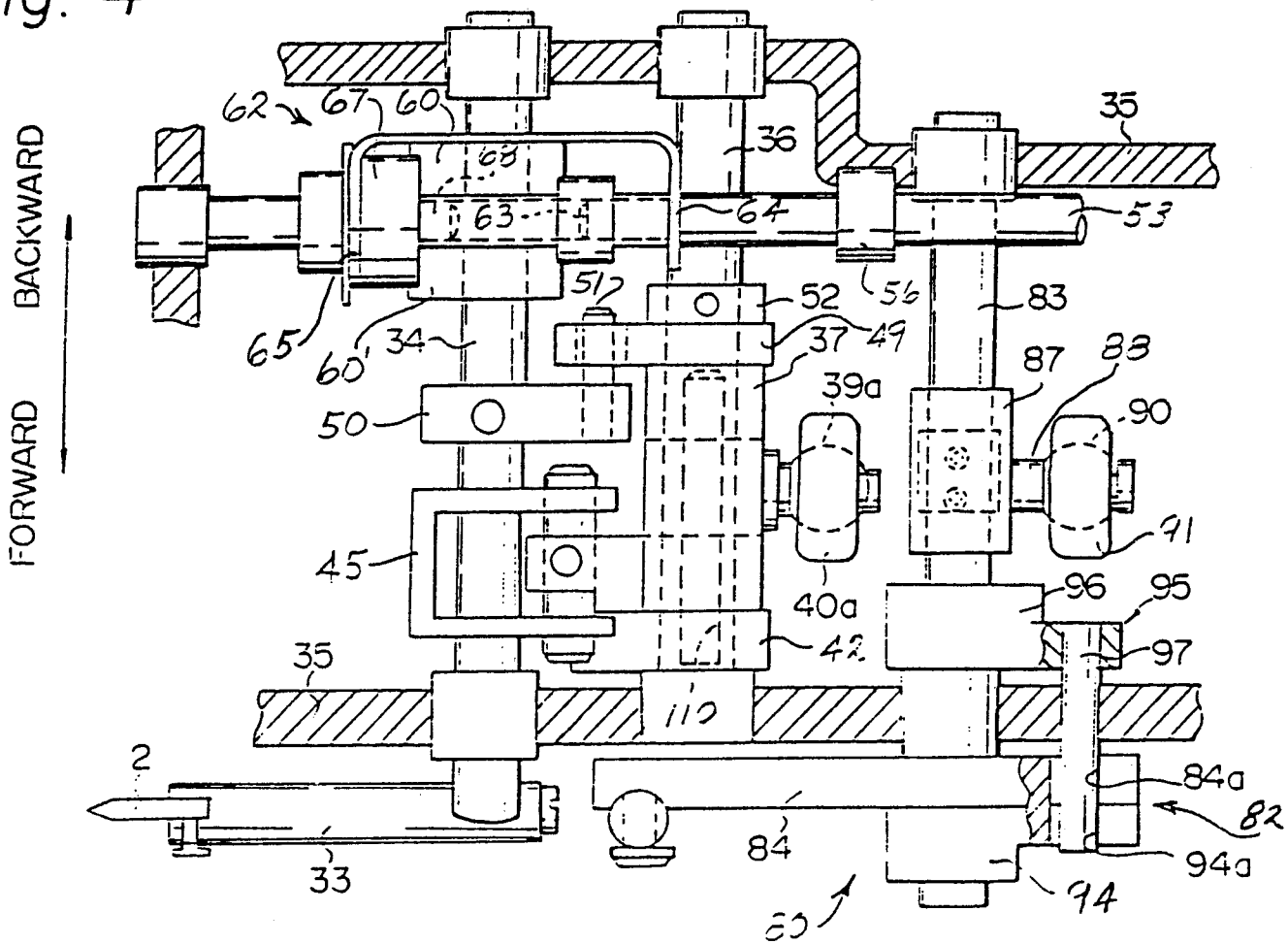
FIG. 4 is a plan view, partially in section, of the lower looper oscillating device, upper looper oscillating device and lower looper back-and-forth oscillating device, when sewing is performed by over-edge stitching.

The lower looper driving mechanism 32 includes a central shaft 36 rotatably carried by the frame 35 of the machine, a driving arm 37 secured to the central shaft 36 for driving the central shaft, and means 38 for oscillating the central shaft driving arm 37. The oscillating means 38 includes a lower looper connection arm 39 secured at its one end to the arm 37, and a lower looper oscillating rod 40 for connecting the lower looper connection arm 37 to the main shaft 5. Specifically, the lower looper connection arm 37 has, at the other end thereof, a ball-shaped portion 39*a* as shown in FIG. 4. The ball-shaped portion 39*a* is so received in a bearing portion 40*a* formed at one end of the lower looper oscillating rod 40 as to provide its spheric motion. An eccentric cam 41 is secured to the main shaft 5. The eccentric cam is rotatably received in a bearing portion 40*b* formed at the opposite end of the lower looper oscillating rod 40. Thus, the lower looper oscillating rod 40 is driven for reciprocal movement in the longitudinal direction, when the main shaft is rotated, so that the central axis driving arm 37 is driven for reciprocal movement (oscillational movement) about the axis of the central shaft 36 for a given angular extent, as shown by an arrow mark S2 in FIG. 2.

The first oscillation connecting mechanism 31 includes a lock change-over arm 42 positioned at one side of the central axis driving arm 37 and mounted on the central shaft 36 for rotation, a lock connection rod 44 pivotally attached to the lock change-over arm at one end thereof and secured to a shaft 43 for a lock oscillation plate at the other end thereof, and a lock oscillation plate 45 secured to the lower looper shaft 34 and carrying thereon the shaft 43 for rotational movement. Accordingly, and when the lock change-over arm 42 is oscillated around the axis of the central shaft 36, the lower looper shaft 34 is oscillationally driven by means of the lock connection rod 44 lock oscillation plate shaft 43 and lock oscillation plate 45. The first oscillation connecting mechanism 31 is designed to be engaged with and disengaged from the central driving arm 37 by means of the motion change-over device 22, the operation of which will be explained later in detail.

The lower looper back-and-forth oscillating device 21, for causing the lower looper 2 to be moved in forward and rearward directions and to be oscillated, includes a second oscillation connecting mechanism 46 for releasably engaging with the lower looper driving mechanism 32, a back-and-forth driving mechanism for moving the lower looper in the forward and rearward directions, and a back-and-forth lock mechanism 48 for locking back-and-forth movement of the lower looper 2.

Figure 5:
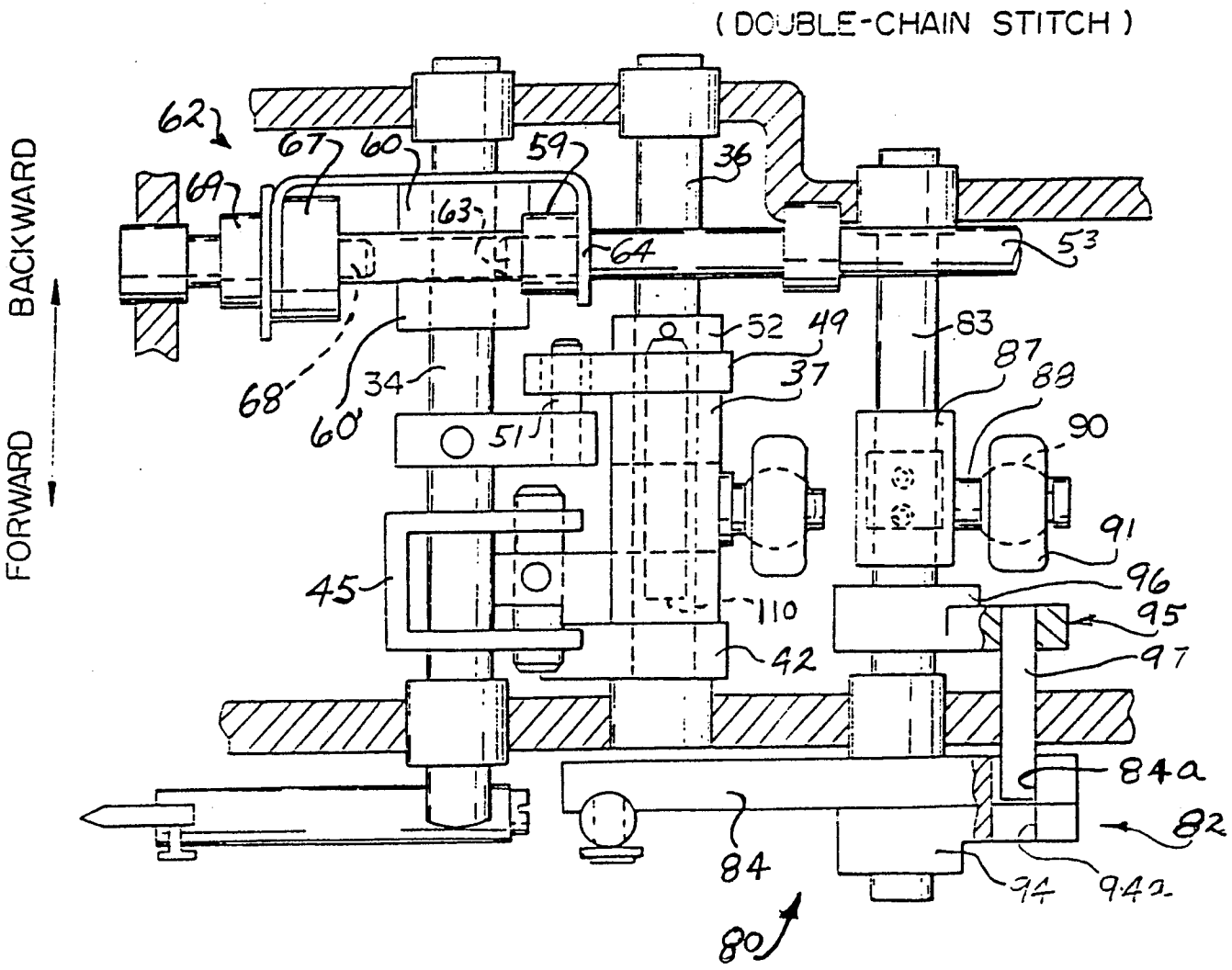
FIG. 5 is a plan view similar to FIG. 4, when a double chain-stitch or the like is formed.

A second oscillation connecting mechanism 46 includes, as shown in FIGS. 2, 4 and 5, a double chain change-over arm 49 rotationally engaged with the central shaft 36 at one end thereof, and a double chain oscillating arm 50 secured to the lower looper shaft 34 at one end thereof and connected to the double chain change-over arm 49 at the other end thereof. A shaft 51 for the double chain oscillating arm 50 is secured to the other end of the double chain oscillating arm. The shaft 51 is smoothly received in a slot 49*a* formed in the other end of the arm 49 (see FIG. 2). The double chain change-over arm 49 is positioned on the other side of the central shaft driving arm 37, i.e., the side of the central shaft driving arm opposite to the lock change-over arm 42 of the oscillation connecting mechanism 31. Reference numeral 52 in FIGS. 2, 4 and 5 designates a collar which prevents the arm 49 from moving in the axial direction of the central shaft 36.

When the arm 49 is oscillated, the lower looper shaft 34 is oscillated by means of the shaft 51 and arm 50. The arm 49 will be actuated by the motion change-over device 22 so as to be engaged with and disengaged from the central shaft driving arm 37.

The mechanism 47 for causing back-and-forth movement of the lower looper 2 includes a back-and-forth oscillating shaft 53 rotatably supported by the frame 35 for movement in the oscillating direction of the lower looper shaft 34 and in the vertical direction, means 54 for oscillating the shaft 53, and means for transmitting oscillational movement of the shaft 53 to to the lower looper shaft 34. The oscillating means 54 includes a link 56 secured to the shaft 53 at one end thereof, and a double chain oscillating rod 57 pivotally connected to the link 56 at one end thereof and connected to the main shaft 5 at the other end thereof. An eccentric cam 58 is fixed to the main shaft 5 and the cam is smoothly fitted into a bearing portion 57*a* formed at the other end of the rod 57. Thus, the back-and-forth oscillating shaft 53 may be oscillated through the rod 57 and link 56, when the main shaft 5 is rotationally driven.

The transmitting means 55 includes, as shown in FIG. 2, a back-and-forth oscillating arm 59 secured to the back-and-forth oscillating shaft 53 at one end thereof, a pair of rings 60, 60′ secured to the lower looper shaft 34, and connection means 61 for engaging and disengaging the back-and-forth oscillating arm relative to the rings.

The connection means includes a back-and-forth oscillation change-over frame 62 attached to the shaft 53, and a back-and-forth oscillating pin 63 secured to the back-and-forth oscillation change-over frame 62. The rings 60, 60' are spaced apart at a predetermined distance from one another and are fixed to the lower looper shaft 34. The back-and-forth oscillation change-over frame 62 includes a pair of spaced side plates 64, 65 and a connection plate for connecting the side plates 64, 65. In the illustrated embodiment, the arm 59 is positioned between one 64 of the side plates of the frame 62 and the lower looper shaft 34. The frame 62 is attached to the back-and-forth oscillating shaft 53 so that the side plates 64, 65 are movable in the longitudinal direction. A back-and-forth oscillating pin 63 is fixed at one end thereof to one of the side plates 64. The pin 63 extends through an elongated aperture 59*a* formed in the arm 59 so as to be engageable with the pair of rings 60, 60' secured to the lower looper shaft 34. In this condition, i.e., when the pin 63 is inserted between the rings 60, 60' through the elongated aperture 59*a* in the arm 59, oscillating motion from the back-and-forth oscillating shaft 53 is transmitted to the lower looper shaft 34 through the arm 59 and pin 63, so that the lower looper shaft, and hence the lower looper 2, is caused to initiate back-and-forth movement R.

Figure 8:
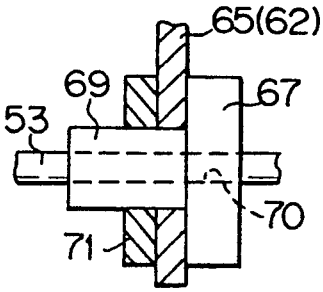
FIG. 8 is a front view, partially in section, of an attachment portion whereby a back-and-forth lock arm is secured to a back-and-forth oscillating change-over frame.
Figure 9:
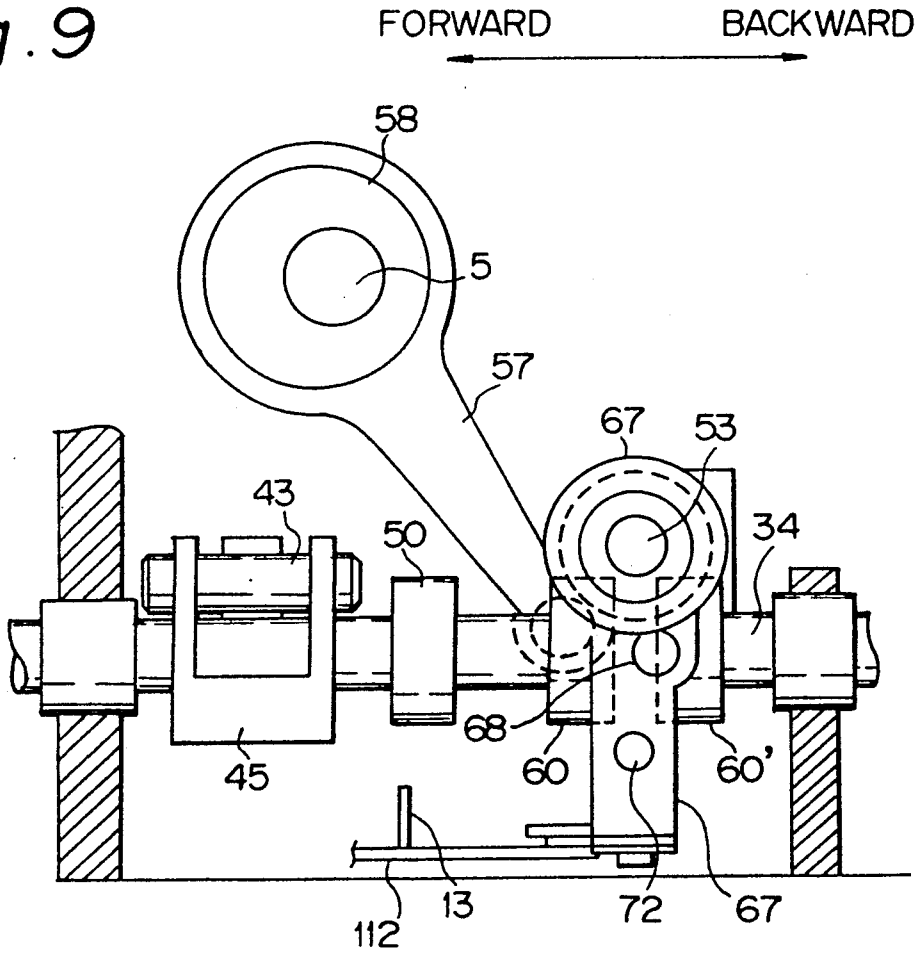
FIG. 9 is a side elevational view, partially in section, of a portion of the first oscillation connecting mechanism and a back-and-forth driving mechanism.

The back-and-forth lock mechanism 48 includes a back-and-forth lock arm 67 secured to the other 65 of the side plates of the frame 62, and a back-and-forth fixing pin 68 attached to the arm 67. The back-and-forth arm 67 is formed with an aperture 70 into which a boss portion 69 and the shaft 53 are freely inserted, as shown in FIG. 8. The boss portion 69 extends through the side plate 65 and is fixed to the side plate 65 by means of a locking ring 71. Accordingly, the back-and-forth lock arm 67 is displaceable along the axis of the back-and-forth oscillating shaft in response to the movement of the frame 62 so as to move toward and away from the lower looper shaft 34. Numeral 72 designates a fixed back-and-forth oscillating shaft which is fixed to the frame 35 at one end thereof and which extends through the back-and-forth lock arm 67 at the other end thereof. The fixed back-and-forth oscillating shaft 72 serves to guide the back-and-forth lock arm 67 to be displaced along the back-and-forth oscillating shaft.

The fixed back-and-forth pin 68 is fixed at one end thereof to the lock arm 67. The other end of the pin 68 is insertable between the rings 60, 60' secured to the lower looper shaft 34.

The lock arm 67 is actuated by means of the motion change-over device 22, the operation of which will be explained later in detail.

It will be appreciated from the foregoing that, when the lock arm 67 is displaced to the right as viewed in FIG. 2, the back-and-forth oscillation change-over frame 62 is also displaced to the right, whereby the fixed pin 68 is inserted between the rings 60, 60', so that the pin 63 may be moved out of a space defined by the rings 60, 60'. At this moment, the lower looper shaft is disengaged from the arm 59 to remain immobile, while back-and-forth movement of the lower looper shaft is locked by means of the pin 68. On the contrary, when the arm 67 is displaced to the left as viewed in FIG. 2, the pin 68 is moved out of the space defined by the rings 60, 60' so that the pin 63 is inserted between the rings 60, 60'. At this moment, the lower looper shaft is unlocked, so that it may be moved back and forth by means of the arm 59.

It should be noted that the lower looper 2 is oscillated by means of the lower looper drive mechanism 32 and first oscillation connecting mechanism 31, while, at the same time, the lower looper 2 is moved back and forth and oscillated by means of the lower looper drive mechanism 32, second oscillation connecting mechanism 46 and back-and-forth drive mechanism 47.

The upper looper oscillating device 23 for oscillating the upper looper 3 includes a mechanism 80 for supporting the upper looper 3, a mechanism 81 for driving the upper looper driving mechanism 80, and an oscillating-/releasing mechanism 82 mounted on the upper looper supporting mechanism 80 (see FIGS. 2, 4 and 5).

The upper looper supporting mechanism 80 includes an upper looper shaft 83, an upper looper oscillating arm 84 rotatably attached at one end thereof to the upper looper shaft, and an upper looper support arm 85 pivotally attached at one end thereof to a free end of the upper looper oscillating arm (see FIGS. 1 and 2). The upper looper 3 is secured to the other end of the upper looper support arm 85. The upper looper support arm 85 is guided by a slide bearing 86 for the upper looper, as shown in FIG. 1. Thus, when the upper looper oscillating arm 84 is oscillated in a direction of arrow S3 in FIG. 2, the lower looper 2 performs a predetermined oscillational movement. The upper looper shaft 83 is disposed substantially in parallel with the lower looper shaft 34 and is supported by the frame 35 of the machine for rotation (see FIGS. 4 and 5).

Figure 10A:
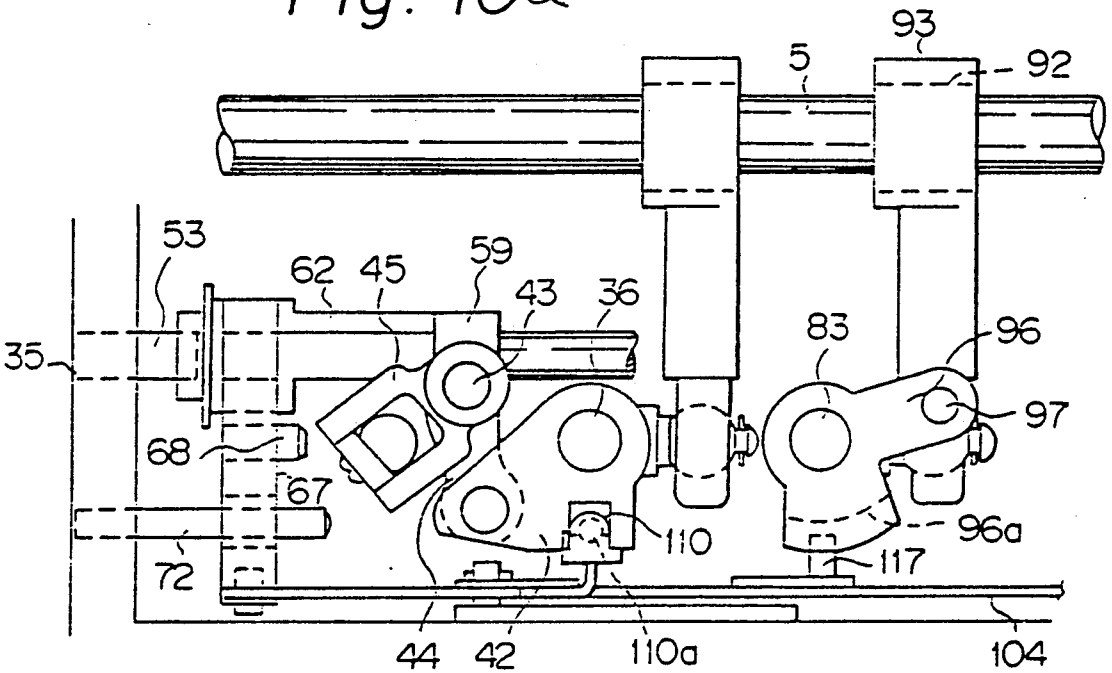
FIG. 10 is a front view illustrating the first oscillation connecting mechanism and upper looper oscillating device, and FIG. 10 b is a fragmentary sectional view illustrating how a change-over pin and a change-over pin engagement member are engaged with each other.
Figure 10B:
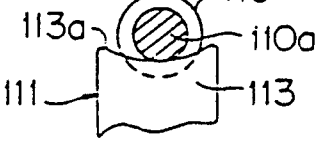

The upper looper drive mechanism 81 includes an upper looper drive arm 87 secured to the upper looper shaft 83, an upper looper connecting arm 88 secured at one end thereof to the arm 87, and an upper looper oscillating rod 89 connecting the arm 88 with the main shaft 5. The upper looper connecting arm 88 is formed, at the other end (i.e., protruding end) thereof, with a ball-shaped portion 90, as shown in FIGS. 4 and 5). The ball-shaped portion 90 is so received in a bearing portion 91 formed at one end of the upper looper oscillating rod 89 as to provide its spheric motion. An eccentric cam 92 is secured to the main shaft 5, as shown in FIG. 10. The eccentric cam 92 is rotatably received in a bearing portion 93 formed at the other end of the upper looper oscillating rod 89. Accordingly, and when the main shaft 5 is rotated, the upper looper drive arm 87, and hence the upper looper shaft 83, becomes reciprocal about the axis thereof within a predetermined angular extent through the upper looper oscillating rod 89 and upper looper connection arm 88.

The oscillating/release mechanism 82 operates to transmit or not to transmit oscillational motion of the lower looper shaft to the upper looper oscillating arm 84. In the illustrated embodiment, the mechanism 82 includes an upper looper oscillation connecting arm 94 secured to the lower looper shaft 83, and a means 95 for engaging or disengaging the upper looper oscillating arm 84 with the upper looper oscillation connecting arm 94. The release means 95 includes an upper looper release body 96 and an upper looper release pin 97 secured to the upper looper release body 96. The upper looper release body 96 is attached to the upper looper shaft 83 so that it may be slidable along the longitudinal axis of the shaft 83. The upper looper release pin 97 is designed so as to be smoothly received in notches 84*a* and 94*a* formed in the upper looper oscillating arm 84 and upper looper oscillation connecting arm 94, respectively (see FIGS. 2 and 4). The upper release body 96 is displaced by means of the motion change-over device 22 between an oscillational position in which the upper release pin 97 is engaged with the upper looper oscillation connecting arm 94 and a non-oscillational position in which the pin 97 is not engaged with the arm 94, the operation of the motion change-over device 22 will be explained below in detail. More particularly, the upper looper release pin 97, in the oscillational position, is engaged with the upper looper oscillation connecting arm 94 and upper looper oscillating arm 84, as shown in FIG. 4, so that oscillational motion of the lower looper shaft 83 may be transmitted to the upper looper oscillating arm 84 through the upper looper oscillation connecting arm 94, whereby the upper looper 3 will be oscillated. On the other hand, the upper looper release pin 97, in the non-oscillational position, is not engaged with the upper looper oscillation connecting arm 94, as shown in FIG. 5, so that oscillational motion of the lower looper 83 is not transmitted to the upper looper oscillating arm 84. It is noted that, in the non-oscillational position, the upper looper 3 is positioned in the lowermost position.

Operation of the motion change-over device 22, which changes operation between the lower looper oscillating device 20 and the lower looper back-and-forth oscillating device 21, will be explained below.

The motion change-over device 22 includes a clutch mechanism 100 for engaging and disengaging the first oscillation connecting mechanism 31 and second oscillation connecting mechanism 46 relative to the lower looper drive mechanism 32, a lock control means 101 for displacing the back-and-forth lock arm 67 of the back-and-forth lock mechanism 48, and a release control means 102 for displacing the upper looper release body 96 of the release means 95. The clutch mechanism 100, lock control means 101 and release control means 102 are located on a frame attachment plate 103 attached to the frame 35 and are driven by means of a main change-over arm 104 of the motion change-over device 22, link means 105 and drive means 106 (see FIGS. 2 and 3).

Figure 3:
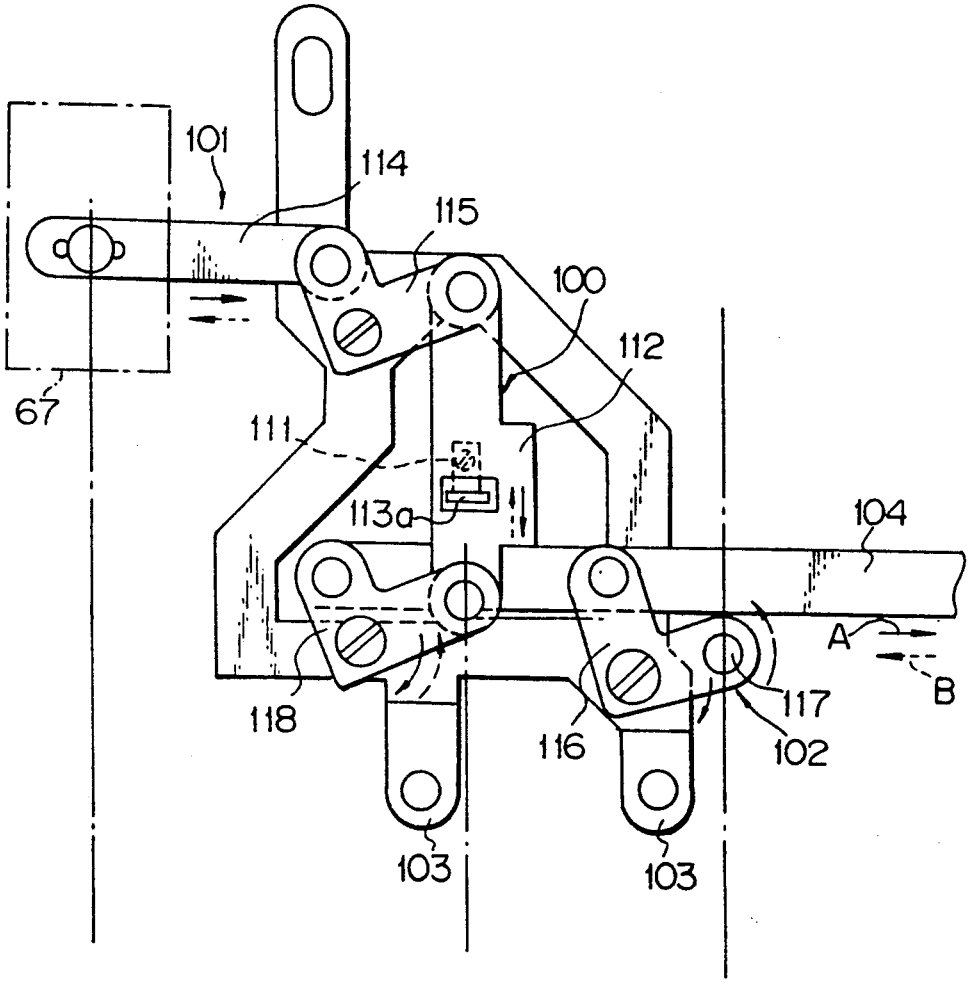
FIG. 3 is a plan view of a main portion of the motion change-over device.
Figure 6:
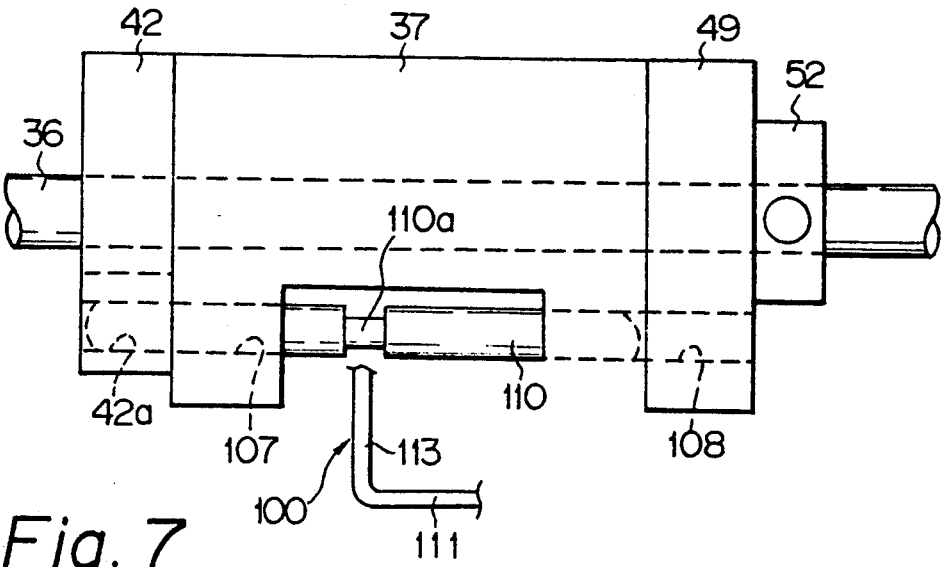
FIG. 6 is a side elevational view of a clutch mechanism wherein a first oscillation connecting mechanism is actuated to perform hem or over-edge stitching.
Figure 7:
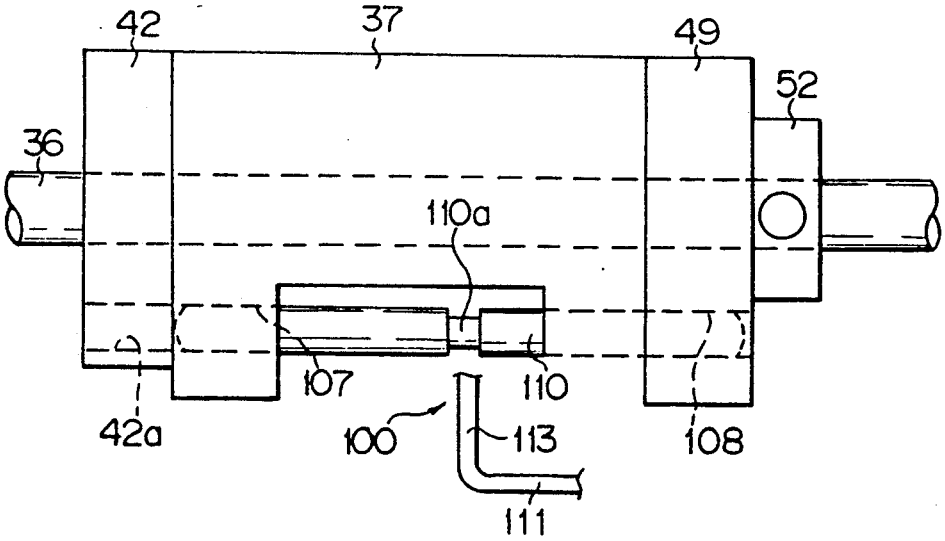
FIG. 7 is a side elevational view of the clutch mechanism wherein a second oscillation connecting mechanism is actuated to perform double chain-stitch.

The clutch mechanism 100 includes, as shown in FIGS. 6 and 7, a change-over pin 110 fitted into a first and second through hole 107, 108 aligned with the underside of the central shaft drive arm 37, double chain change-over arm 49 and lock change-over arm 42, respectively and into a bifurcate portion 42 of the lock change-over arm 42 (see FIGS. 2 and 6), a change-over pin engagement member 111 engageable with the change-over pin 110, and a first change-over arm 112 supporting the engagement member 111 (see FIG. 3). The engagement member 111 is fixed to the first change-over arm 112. The change-over pin 110 is arranged substantially in parallel with the central shaft 36 and is slidable within the first and second through holes and the bifurcate portion 42*a*. The change-over pin 110 is formed at its substantially central portion a reduced portion 110*a* as shown in FIGS. 6 and 7. The distal end surface 113*a* of a protruding portion 113 of the engagement member 111 is formed into a curved surface in correspondence with the outer diameter of the reduced portion 110*a* so as to carry the reduced portion thereon.

The lock control means 101 includes a second change-over arm 114 (FIG. 3) having one end fixed to the underside of the lock arm 67. The other end of the second change-over arm 114 is connected to the first change-over arm 112 through the first change-over lever 115 (see FIG. 3).

The release control means 102 includes an upper looper release change-over arm 116 which connects the main change-over arm 104 with the upper looper release body 96. The arm 116 is pivotally connected to the frame attachment plate 103 at its substantially central portion, and also pivotally connected to the main change-over arm 104 at its other end. An engagement pin 117 is connected to the other end of the upper looper release change-over arm 116. The engagement pin 117 is inserted in the groove 96*a* (FIG. 10) formed in the upper looper release body 96.

The main change-over arm 104 and first change-over arm 112 are connected to each other by a second change-over lever 118.

With the above arrangement, the main change-over arm 104 is displaced longitudinally, to drive the upper looper release body 96 through the upper looper release change-over arm 116 along the upper looper shaft 83. The first change-over arm 112 is then driven through the second change-over arm 118 to displace the change-over pin 110, and further the second change-over arm 114 is driven through the first change-over lever 115 to displace the back-and-forth lock arm 67 (see FIG. 3).

The drive means 106 for the motion change-over device 22 includes, in the illustrated embodiment, a stitch conversion dial 201 disposed behind a frame 200 of the machine (FIG. 1), a stitch conversion cam 202 fixed to a shaft of the dial 201, and a conversion lever 203 having one end engaging with the cam 202.

The link means 105 includes a rod 204 pivotally connected to the other end of the conversion lever 203 at one end thereof, a conversion drive arm 205 pivotally connected to the other end of the rod 204 at one end thereof, a bracket 206 fixed to the main change-over arm 104, and an adjustment shaft 207 connecting the arm 205 to the bracket 206.

Consequently, rotation of the stitch conversion dial 201 will longitudinally move the main change-over arm 104 through the stitch conversion cam 202, conversion lever 203 and link means 106.

In FIG. 3, a first movement of the main change-over arm 104 shown in solid line as indicated by an arrow A when performing "roll hem stitching", while a second motion or displacement of the main change-over arm shown in phantom line as indicated by an arrow mark B occurs when performing "double chain stitching".

The dial 201, cam 202, lever 203 and link means 105 are designed so that, when the dial 201 is rotated, the change-over operation between the lower looper oscillating device 20 and lower looper back-and-forth oscillating device 21, together with control for the upper looper oscillating device 23 are performed corresponding to various stitch formation, such as over-edge stitch and double chain stitch or the like. The dial 201 is preferably provided with indications representing the respective stitch formations for the convenience of selection thereof.

As will be appreciated from the foregoing, conversion of various stitch formations may be readily made by simply rotating the dial 201.

Operation of the overlock sewing machine according to the invention will be explained below.

It should be noted that, in general, the lower looper 2 is only oscillated by the lower looper oscillating device, when performing "over-edge stitching". In this case, the lower looper 2 is prevented from back-and-forth movement, while the upper looper 3 is actuated by the upper looper oscillating device 23. Accordingly, "over-edge stitching" may be performed by means of oscillational motion of the lower looper and oscillational motion of the upper looper (see FIG. 4).

When it is intended to perform "double chain stitching", the lower looper 2 is driven by the lower looper back-and-forth oscillating device 21 so as to exert both back-and-forth motion and oscillational motion. In this case, the upper looper 3 will not be oscillated. Thus, "double chain stitching" will be performed (see FIG. 5).

Operation for performing a stitching of each of the seam patterns will be explained below.

Over-edge stitching and roll hem stitching

The stitch conversion dial 201 of the motion change-over device 22 is rotated to assume a position where an over-edge stitch is formed. Thus, the main change-over arm 104 is actuated in the first displacement direction A by the link means 105, as shown by the solid line in FIG. 2.

The respective mechanisms and components are actuated according to the following steps. First, the upper looper release body 96 is displaced on the upper looper shaft 83 toward the upper looper oscillating arm 84 by means of the upper looper release change-over arm 116, so that the upper looper release pin 97 is received within the notch or groove 94*a* in the upper looper oscillation connecting arm 94. In this state, the upper looper release pin 97 is engaged with both the upper looper oscillating arm 84 and upper looper oscillation connecting arm 94, so that oscillational motion of the upper looper, caused by the upper looper drive mechanism 81, shaft 83 is transmitted to the upper looper 3 through the upper looper oscillating arm 84 and upper looper support arm 85. Thus, the upper looper will be actuated in a predetermined oscillational motion. Second, the first change-over arm 112 is displaced in a direction shown by solid line in FIG. 3 by means of the second change-over lever 118. More particularly, the change-over pin engagement member 111 urges one end of the change-over pin 110 into the bifurcate portion 42*a* of the lock change-over arm 42. In this state, the other end of the change-over pin 110 is disengaged from the second through hole 108 in the double chain change-over arm 49. Thus, the change-over pin 110 is received within both the first through hole 107 in the central shaft drive arm 37 and the bifurcate portion 42*a* of the lock change-over arm 42. Such an arrangement is shown in FIG. 6. In this state, the oscillational motion of the central shaft 36 caused by the lower looper drive mechanism 32 is transmitted through the central shaft drive arm 37 and first oscillation connecting mechanism 31, namely through the lock change-over arm 42, rod connection rod 44 and lock oscillating plate 45, to the lower looper shaft 34 and lower looper support arm 33, and then to the lower looper 2. Thus, the lower looper 2 performs a predetermined oscillational motion. It should be noted that, in this state, the second oscillation connecting mechanism 46 is disengaged or released, whereby motion of the central shaft drive arm 37 cannot be transmitted to the double chain change-over arm 49. This is because that the change-over pin 110 is disengaged or withdrawn from the second through hole 108.

Third the second change-over arm 114 is displaced in a direction shown by solid line in FIG. 3 to displace the back-and-forth lock arm 67 and back-and-forth oscillation change-over frame 62 to the right as viewed in FIG. 2. Then, the back-and-forth fixing pin 68 is inserted into a space between the pair of rings 60, 60' secured to the lower looper shaft 34, while the back-and-forth oscillating pin 63 is disengaged or withdrawn from the space between the pair of rings 60, 60'. Accordingly, back-and-forth motion of the lower looper is locked or prevented as mentioned above.

As explained above, the lower looper 2 only performs oscillational motion to form over-edge stitch in cooperation with the oscillational motion of the upper looper 3.

Double Chain Stitching

First, the stitch conversion dial 201 is turned to assume a position where a double-chain stitch is formed. Then, the main change-over arm 104 is actuated to perform the second displacement B as shown by phantom line in FIG. 2. In this manner, the upper looper release body 96 is displaced away from the upper looper oscillating arm 84 by means of the upper looper release arm change-over arm 116, whereby the upper looper release pin 97 is disengaged or withdrawn from the change-over groove 94*a* in the upper looper oscillation connecting arm 94. Thus, motion of the upper looper shaft 83 is not transmitted to the upper looper oscillating arm 84, so that the upper looper 3 is not oscillated. In this state, the upper looper becomes free when positioned in the lowermost position. Then, the first change-over arm 112 is displaced in a direction shown by a phantom line in FIG. 3 by means of the second change-over lever 118. By this, the change-over pin engaging member 111 urges the other end of the change-over pin 110 into the second through hole 108 in the double chain change-over arm 49, so that the one end of the pin 110 is disengaged from the bifurcate portion 42*a* of the lock change-over arm 42 (see FIG. 7). At this stage, the first oscillation connecting mechanism 31 is released, while the second oscillation connecting mechanism 46 is connected with the lower looper drive mechanism 32. Accordingly, oscillational motion of the lower looper drive mechanism is transmitted to the lower looper shaft 34 through the second oscillation connecting mechanism 46, namely the double chain change-over arm 49, double chain oscillating arm shaft 51 and double chain oscillating arm 50. Thus, oscillational motion of the lower looper 2 is initiated. The second change-over arm 114, on the other hand, is displaced to the left as viewed in FIG. 2 in response to displacement of the first change-over arm 112 in the direction shown by phantom line in FIG. 3. This causes the back-and-forth oscillation change-over frame 62 to be displaced to the left as viewed in FIG. 2, whereby the back-and-forth oscillating pin 63 is inserted in the space between the rings 60, 60' which extend through the bore 59*a* in the back-and-forth oscillating arm 59 and are fixed to the lower looper shaft 34. At the same time, the back-and-forth fixing pin 68 becomes disengaged from a space between the rings 60, 60'. Accordingly, back-and-forth motion is transmitted to the lower looper shaft 34 through the back-and-forth drive mechanism 47.

Consequently, the lower looper 2 is moved back and forth and oscillated to contribute much to formation of double chain stitch of the like.

Figure 11:
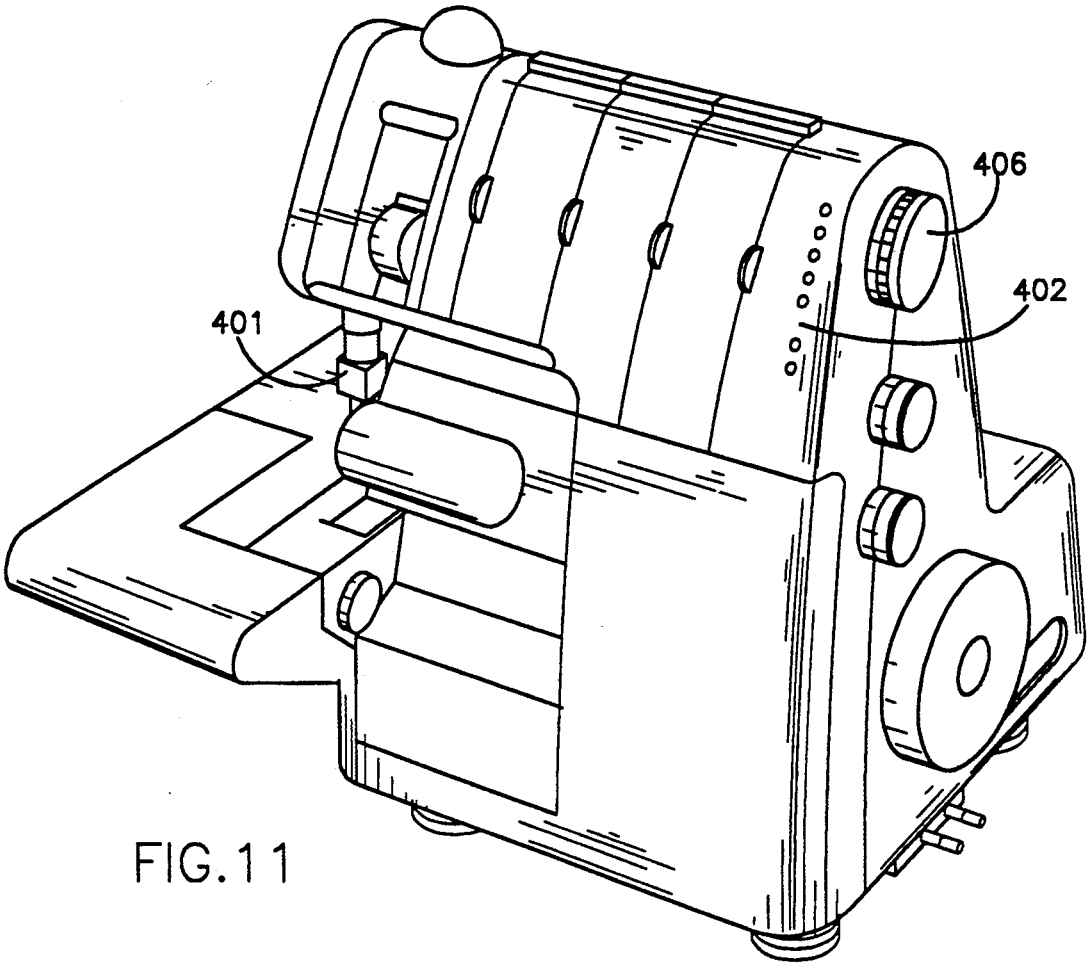
FIG. 11 is a perspective view of an overlock machine to which the invention may be incorporated.

FIG. 11 is a perspective view of an overlock machine. The overlock machine permits plural kinds of sewing, such as twin-needle/four-thread overlock stitching, single-needle/two-thread overlock stitching, double chain stitching or the like.

In the drawing, reference numeral 401 designates a needle clamp which includes four (4) needle attachment positions.

Figure 12:
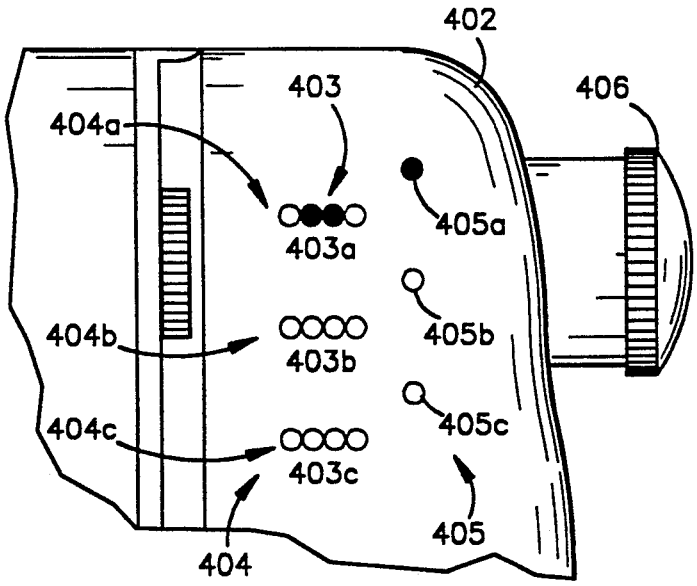
FIG. 12 is a front view of one embodiment of needle position indicator devices for an overlock machine according to the invention.
Figure 13:
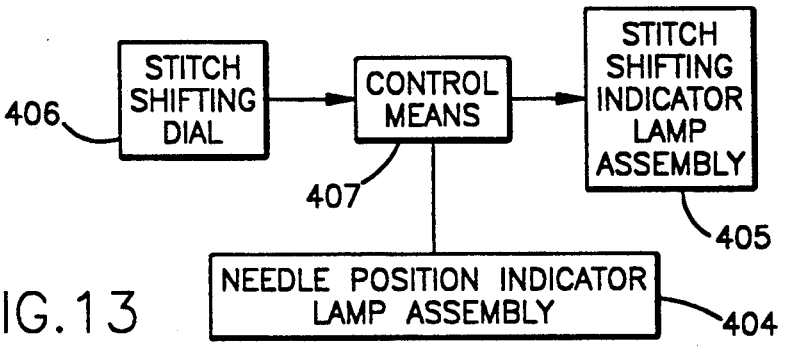
FIG. 13 is a block diagram illustrating functional operation of the invention.

As shown in FIG. 12, reference numeral 402 is a front cover of the machine. Reference numeral 403 designates a plurality of literal indicators for indicating kind of seam.

The front cover 402 includes three literal indicators 3A, 3B and 3C at the righthand side thereof. Numeral 404 designates a needle position indicator lamp assembly. Each needle position indicator is consisted of four lamps. Each lamp corresponds to a position to indicate a needle attachment position of the needle clamp 401. The lamps 404A, 404B and 404C are positioned below the literal indicators 403A, 403B and 403C, respectively. Numeral 405 designates a stitch shifting indicator lamp assembly. The set of seam pattern indicators includes lamps 405A, 405B and 405C which correspond to the above-mentioned twin-needle/four-thread overlock stitching, double chain stitching, etc., respectively. Numeral 406 designates a stitch shifting dial. The seam pattern change-over dial 406 is used to change thread tension in the overlock machine, looper oscillation amount, and stroke of balance. Every rotation of the seam pattern change-over dial in a predetermined amount causes an electrical signal which will be explained later.

An electrical signal to be generated upon every predetermined amount of rotation of the dial 406 is sent to a controller 407. The controller 407, upon receipt of electrical signal, transforms the signal and outputs the same to the stitch shifting indicator lamp assembly 405 and needle position indicator lamp assembly 404 so as to turn on corresponding lamps of the stitch shifting indicator lamp assembly 405 and needle position indicator lamp assembly 404.

Operation of the overlock machine will be explained below.

When it is intended to change seam pattern, the stitch shifting dial 406 is rotated, until the stitch shifting indicator lamp 405 corresponding to the literal indicator 403 for the intended seam pattern will be turned on, so as to change the amount of oscillation of the looper and the amount of stroke of the balance, whereby the seam pattern is determined.

For example, and when the stitch shifting dial 406 is rotated so as to turn on the stitch shifting indicator lamp 5A for twin needle/four-thread overlock stitching, needle attachment positions (shaded portion in FIG. 12) of the needle position indicator lamp 4A are turned on, whereby the needle attachment position of the needle clamp 401 can be determined.

By this, the lamp 4A corresponding to a needle hole, to which the needle of the needle clamp 401 is to be attached, is turned on depending upon intended stitch pattern, so that the suitable needle can be attached, accordingly.

Figure 14:
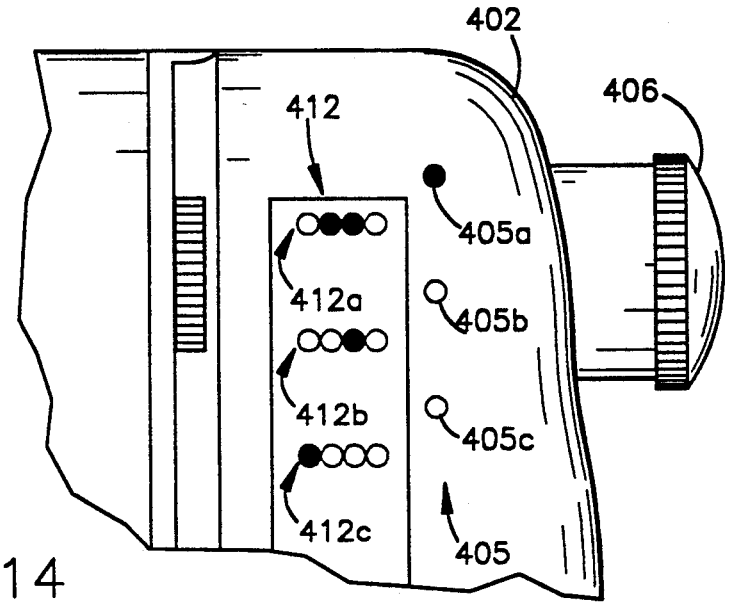
FIG. 14 illustrates another embodiment of the invention.

While the embodiment shown in FIG. 12 is so configured that the needle position indicator lamp 404 is turned on by means of a needle position indicator signal from the control means 407, the embodiment shown in FIG. 14 includes a paper sheet or the like having thereon a plurality of needle position indicator 412 adjacent to the stitch shifting indicator lamps. Stitch shifting indicator lamps 405A, 405B and 405C are arranged so that they correspond to the needle position indicator 412A, 412B and 412C, respectively. When one of the lamps is turned on, a needle attachment position (shaded portion in the drawing) in the needle clamp 401 corresponding to that lamp can be determined.

Figure 15:
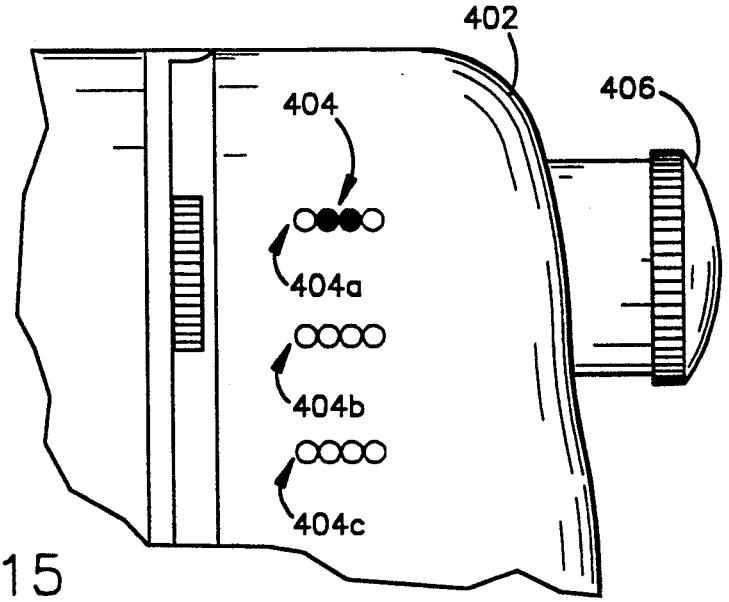
FIG. 15 illustrates further embodiment of the invention.

Further embodiments will be given as follows. The embodiment shown in FIG. 15 merely includes, in the front cover 402, a needle position indicator 404 similar to that shown in FIG. 12. Any signal generated upon actuation of the stitch shifting dial 406 is transformed by means of the control means 407, so that a lamp or lamps corresponding to a needle to be attached to the needle clamp 401 at a selected stitch pattern is (are) turned on.

Figure 16:
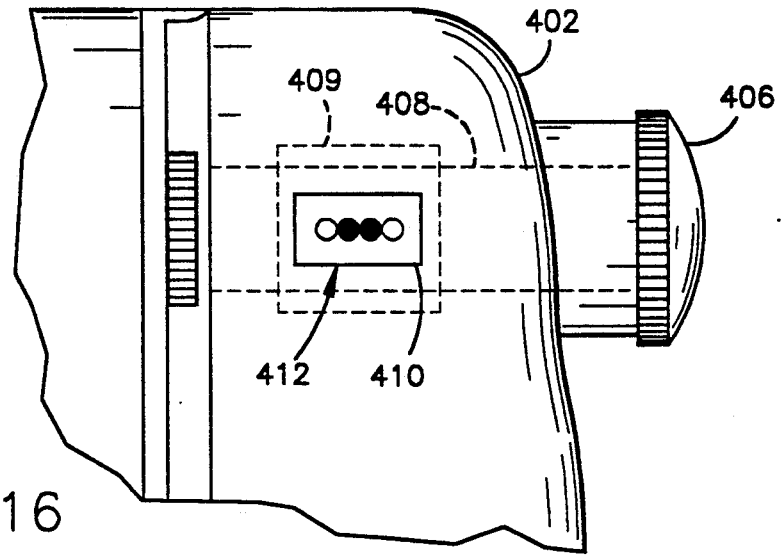
FIG. 16 illustrates still another embodiment of the invention.

In the embodiment shown in FIG. 16, an indicator drum 409 having thereon a plurality of needle position indicators 412 is provided on a shaft 408 of the stitch shifting dial 406. A transparent window 410 is provided at a portion of the front cover 412 so that the indicator drum 409 may be viewed therethrough. When the stitch shifting dial 406 is rotated, corresponding one of the needle position indicators 412 will be indicated.

Figure 17:
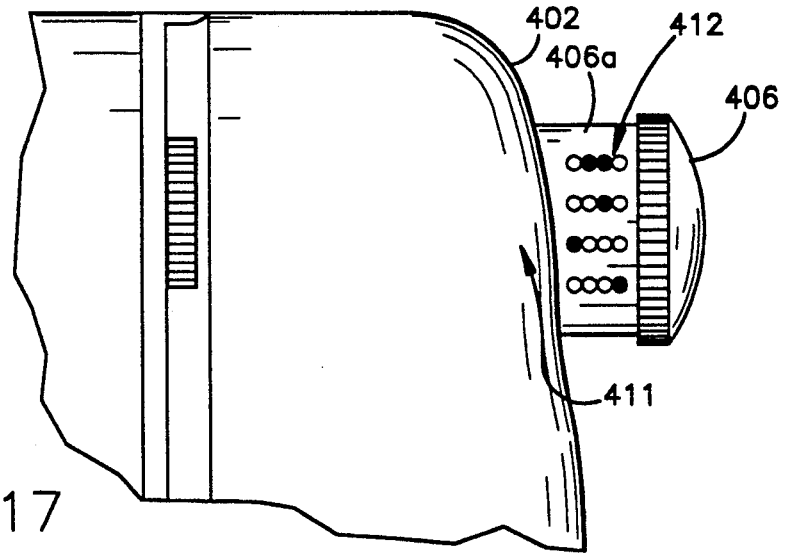
FIG. 17 illustrates still further embodiment of the invention.
Figure 18:
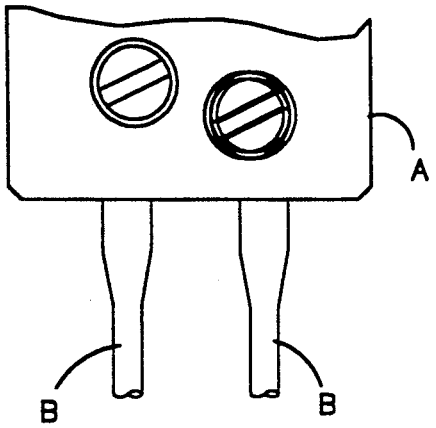
FIG. 18 is a plan view of a needle clamp member.
Figure 19:
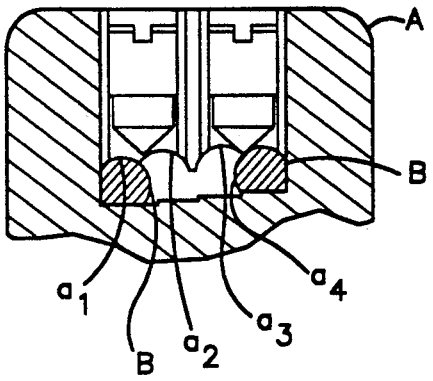
FIG. 19 is a cross-sectional view of FIG. 18.

In the embodiment shown in FIG. 17, a plurality of needle position indicators 412 are provided in the periphery 406A of the stitch shifting dial 406. An index 411 is provided on the front cover 402. The stitch shifting dial 406 is rotated and a needle is attached to a needle attachment position of the needle position indicator 412 indicated by the index 411.

According to the invention, there will be little possibility for a needle to be erroneously attached, even when a position of the needle bar to which the needle is attached is changed due to the change in stitch pattern, so that a predetermined stitch pattern may be properly formed. In addition, attachment of the needle is performed in easy and quick manner, thus increasing operation efficiency.

The principles, preferred embodiments and modes of operation of the present invention have been described in the foregoing specification. The invention which is intended to be protected herein should not, however, be construed as being limited only to the particular form described which is to be regarded as illustrative rather than restrictive. Variations and modifications may be made by those skilled in the art without departing from the spirit of the present invention. Accordingly, the foregoing detailed description should be regarded as exemplary in nature and not as limiting the scope and spirit of the invention set forth in the appended claims.

We claim:

1. A needle attachment position indicator device for use in a sewing machine of a type comprising a stitch pattern forming mechanism changeable between a first stitch pattern in which a lower looper is connected to a main shaft of the machine, and a second stitch pattern in which the lower looper and an upper looper are connected to the main shaft of the machine, an actuator member actuatable to permit selection of a kind of stitch patterns, a change-over mechanism disposed between the stitch pattern forming mechanism and the actuator mechanism for changing the stitch pattern forming mechanism into one of the stitch patterns in response to the actuation of the actuator member, and a needle holding member disposed at the lower end of a needle bar, said needle holding member including a plurality of needle holding portions for removably holding a needle, said needle holding member cooperating with the stitch pattern forming mechanism in the first or second stitch pattern to permit formation of different stitch patterns, depending upon the needle holding portion to which the needle is attached, characterized by that said needle attachment position indicator device includes an indicator means for indicating a needle holding portion corresponding to the stitch pattern selected in relation to the selective actuation of said actuator member.

2. The needle attachment position indicator device in accordance with claim 1, wherein said indicator means is disposed on said actuator member or machine frame.

3. A needle attachment position indicator device for use in a sewing machine of a type comprising at stitch pattern forming mechanism changeable between a first stitch pattern in which a lower looper is connected to a main shaft of the machine, and a second stitch pattern in which the lower looper and an upper looper are connected to the main shaft of the machine, an actuator member actuatable to permit selection of a kind of stitch patterns, a change-over mechanism disposed between the stitch pattern forming mechanism and the actuator mechanism for changing the stitch pattern forming mechanism one of the stitch patterns in response to the actuation of the actuator member, and a needle holding member disposed at the lower end of a needle bar and including a plurality of needle holding portions for removably holding a needle, whereby permitting formation of different stitch patterns by means of the stitch pattern forming mechanism in the first or second stitch pattern, depending upon the needle holding portion to which the needle is attached, characterized by that said needle attachment position indicator device includes an indicator member for indicating a needle holding portion to which the needle is to be attached, in correspondence to the stitch pattern selected in response to the selective actuation of said actuator member.

4. The needle attachment position indicator device in accordance with claim 3, wherein said indicator member is disposed on said actuator member or machine frame.

5. A needle attachment position indicator device for use in a sewing machine of a type comprising a stitch pattern forming mechanism changeable between a first stitch pattern in which a lower looper is connected to a main shaft of the machine, and a second stitch pattern in which the lower looper and an upper looper are connected to the main shaft of the machine, an actuator member actuatable to permit selection of a kind of stitch patterns, a change-over mechanism disposed between the stitch pattern forming mechanism and the actuator mechanism for changing the stitch pattern forming mechanism into one of the stitch patterns in response to the actuation of the actuator member, and a needle holding member disposed at the lower end of a needle bar and including a plurality of needle holding holes for removably holding a needle, said holes being arranged along a horizontal axis transversely to the cloth feeding direction, whereby permitting formation of different stitch patterns by means of the stitch pattern forming mechanism in the first or second stitch pattern, depending upon the manner of installation of the needle relative to the needle holding holes, characterized by that said needle attachment position indicator device includes an indicator member for indicating combination of said needle holding holes to which the needle is to be installed, in correspondence to the stitch pattern selected in response to the selective actuation of said actuator member.

6. The needle attachment position indicator device in accordance with claim 3, wherein said indicator member is arranged in correspondence to said needle holding portions.

7. The needle attachment position indicator device in accordance with claim 1, wherein said indicator member is arranged in correspondence to said needle holding portions.

* * * * *